US007481678B2

(12) United States Patent
Aekins

(10) Patent No.: US 7,481,678 B2
(45) Date of Patent: Jan. 27, 2009

(54) MODULAR INSERT AND JACK INCLUDING BI-SECTIONAL LEAD FRAMES

(75) Inventor: Robert A. Aekins, Quaker Hill, CT (US)

(73) Assignee: Ortronics, Inc., New London, CT (US)

( * ) Notice: Subject to any disclaimer, the term of this patent is extended or adjusted under 35 U.S.C. 154(b) by 0 days.

(21) Appl. No.: 11/818,478

(22) Filed: Jun. 14, 2007

(65) Prior Publication Data

US 2008/0311778 A1 Dec. 18, 2008

(51) Int. Cl.
*H01R 24/00* (2006.01)

(52) U.S. Cl. ..... 439/620.11; 439/620.13

(58) Field of Classification Search ..... 439/620.11, 439/620.13, 620.09, 676
See application file for complete search history.

(56) References Cited

U.S. PATENT DOCUMENTS

| | | | |
|---|---|---|---|
| 5,387,135 | A | 2/1995 | Shen et al. |
| 5,415,570 | A | 5/1995 | Sarkissian |
| 5,501,608 | A | 3/1996 | Scheer et al. |
| 5,513,065 | A | 4/1996 | Caveney et al. |
| 5,599,209 | A | 2/1997 | Belopolsky |
| 5,618,185 | A | 4/1997 | Aekins |
| 5,687,478 | A | 11/1997 | Belopolsky |
| 5,772,466 | A | 6/1998 | Morin et al. |
| 5,941,734 | A | 8/1999 | Ikeda et al. |
| 5,967,853 | A | 10/1999 | Hashim |
| 5,975,960 | A | 11/1999 | Fogg et al. |
| 6,056,568 | A | 5/2000 | Arnett |
| 6,065,985 | A | 5/2000 | Marshall |
| 6,139,371 | A | 10/2000 | Troutman et al. |
| 6,155,881 | A | 12/2000 | Arnett et al. |
| 6,162,077 | A | 12/2000 | Laes et al. |
| 6,165,018 | A | 12/2000 | Arnett et al. |
| 6,165,023 | A | 12/2000 | Troutman et al. |
| 6,168,474 | B1 | 1/2001 | German et al. |
| 6,176,742 | B1 | 1/2001 | Arnett et al. |
| 6,186,834 | B1 | 2/2001 | Arnett et al. |
| 6,193,533 | B1 | 2/2001 | De Win et al. |
| 6,231,397 | B1 | 5/2001 | de la Borbolla et al. |
| 6,244,906 | B1 | 6/2001 | Hashim et al. |
| 6,276,971 | B1 | 8/2001 | Belopolsky |
| 6,305,950 | B1 | 10/2001 | Doorhy |
| 6,332,810 | B1 | 12/2001 | Bareel |
| 6,346,010 | B1 | 2/2002 | Emplit |
| 6,371,793 | B1 | 4/2002 | Doorhy et al. |
| 6,379,157 | B1 | 4/2002 | Curry et al. |
| 6,402,560 | B1 | 6/2002 | Lin |
| 6,409,547 | B1 * | 6/2002 | Reede ..... 439/676 |
| 6,428,362 | B1 | 8/2002 | Phommachanh |
| 6,443,777 | B1 | 9/2002 | McCurdy et al. |
| 6,464,541 | B1 | 10/2002 | Hashim et al. |

(Continued)

*Primary Examiner*—Gary F. Paumen
(74) *Attorney, Agent, or Firm*—McCarter & English, LLP

(57) ABSTRACT

The present disclosure is related to a modular insert and associated jack assembly used in telecommunication connector systems that reduces the adjacent lines electro magnetic interference from an adjacent transmitter for different plug assemblies. The internal contacts/lead frames feature a bi-sectional design. Internal EMI line reduction is allowed only when the bi-sectional contacts are electrically mated by a plug with corresponding contact layout. By isolating the contact sections in the interface system, the coupled signal for EMI balance is optionally utilized in a low cost and manufacturable design.

31 Claims, 10 Drawing Sheets

U.S. PATENT DOCUMENTS 6,533,618 B1 3/2003 Aekins
6,544,076 B2 4/2003 Pocrass
6,558,203 B2 5/2003 Pocrass
6,568,965 B2 5/2003 Pocrass
6,572,411 B1 6/2003 Aeschbacker et al.
6,576,853 B2 6/2003 Motojima
6,592,397 B2 7/2003 Pocrass
6,595,805 B2 7/2003 Pocrass
6,612,876 B2 9/2003 Hyland
6,612,877 B2 9/2003 Hyland
6,663,436 B1 12/2003 Arnett et al.
6,736,681 B2 5/2004 Arnett
6,758,698 B1 7/2004 Caveney et al.
6,796,847 B2 9/2004 AbuGhazaleh et al.
6,799,989 B2 10/2004 Doorhy et al.
6,916,209 B1 7/2005 Casher et al.
6,923,673 B2 8/2005 Doorhy et al.
6,964,587 B2 * 11/2005 Colantuono et al. ..... 439/676
7,021,971 B2 4/2006 Chou et al.
7,074,092 B1 7/2006 Green et al.
7,114,985 B2 10/2006 Doorhy et al.
7,153,168 B2 12/2006 Caveney et al.
7,166,100 B2 1/2007 Jordan et al.
7,175,476 B2 2/2007 Kim et al.
7,179,131 B2 2/2007 Caveney et al.
7,190,594 B2 3/2007 Hashim et al.
RE39,546 E 4/2007 Phommachanh
7,281,957 B2 10/2007 Caveney
7,309,261 B2 12/2007 Caveney et al.
7,314,393 B2 1/2008 Hashim
7,319,131 B2 1/2008 Swedo et al.
2002/0081908 A1 * 6/2002 Ahn et al. ..... 439/676
2007/0254529 A1 11/2007 Pepe et al.
2007/0259572 A1 11/2007 Celella et al.

* cited by examiner

MODULAR INSERT AND JACK INCLUDING BI-SECTIONAL LEAD FRAMES

BACKGROUND

1. Technical Field

The present disclosure is directed to modular insert assemblies and, more particularly, to modular insert assemblies that include bi-sectional contacts that allow interrupted communications across individual contacts, e.g., based upon interaction with corresponding plug contacts.

2. Background Art

Devices for interfacing with high frequency data transfer media are generally known. Modular jack housing inserts have been developed that facilitate interface with connectors, i.e., plugs, that in turn interact with unshielded twisted pair (UTP) media. UTP media finds widespread application in structured cabling applications, e.g., in local area network (LAN) implementations and other in-building voice and data communications applications. In a UTP cable, a plurality of twisted copper pairs are twisted together and wrapped with a plastic coating. Individual wires generally have a diameter of 0.4-0.8 mm. Twisting of the wires increases the noise immunity and reduces the bit error rate (BER) associated with data transmission thereover. Also, using two wires rather than one to carry each signal permits differential signaling to be used, which offers enhanced immunity to the effects of external electrical noise.

As an alternative to UTP media, shielded twisted pair (STP) media is used in certain structured cabling applications. STP media includes shielding, e.g., a foil or braided metallic covering, that generally reduces the effects of outside interference. However, as compared to STP media, UTP media offers reduced cost, size and cable/connector installation time. In addition, the use of UTP media, as opposed to STP media, eliminates the possibility of ground loops (i.e., current flowing in the shield because the ground voltage at each end of the cable is not exactly the same, thereby potentially inducing interference into the cable that the shield was intended to protect). In short, UTP media is a flexible, low cost media having widespread application in voice and/or data communications.

The wide acceptance and use of UTP for data and voice transmission is also driven by the large installed base, low cost and ease of new installations. Another important feature of UTP is that it can be used for varied applications, such as for Ethernet, Token Ring, FDDI, ATM, EIA-232, ISDN, analog telephone (POTS), and other types of communication. This enables the same type of cable and system components (such as jacks, plugs, cross-patch panels and patch cables) to be used for an entire building installation, unlike STP media.

UTP media is being used for systems having increasingly higher data rates. In data transmission, the signal originally transmitted through the data transfer media is not necessarily the signal received. The received signal will consist of the original signal as modified by various distortions and additional unwanted signals introduced over the transmission path. Such distortions and unwanted signals affect the original signal between transmission and reception and are commonly collectively referred to as "electrical noise" or simply "noise." Noise can be a primary limiting factor in the performance of a communication system. Indeed, many problems may arise from the existence and/or introduction of noise during data transmission, such as data errors, system malfunctions and loss of the original signals (in whole or in part).

The transmission of data by itself causes unwanted noise. Electromagnetic energy, induced by the electrical energy in the individual signal carrying lines within the data transfer media and data transfer connecting devices, radiates onto adjacent lines in the same media or device. This cross coupling of electromagnetic energy (i.e., electromagnetic interference or EMI) from a "source" line to a "victim" line is called crosstalk. Most data transfer media consist of multiple pairs of lines bundled together. Communication systems typically incorporate many such media and connectors for data transfer. Thus, there exists an opportunity for significant crosstalk interference.

Electromagnetic energy waves can be derived by Maxwell's wave equations. These equations are basically defined using electric and magnetic fields. In unbounded free space, a sinusoidal disturbance propagates as a transverse electromagnetic wave. This means that the electric field vectors are perpendicular to the magnetic field vectors lying in a plane perpendicular to the direction of the wave. Crosstalk results in a waveform shaped differently than the one originally transmitted.

Crosstalk can be categorized in one of two forms. Near end crosstalk, commonly referred to as NEXT, arises from the effects of near field capacitive (electrostatic) and inductive (magnetic) coupling between source and victim electrical transmissions. NEXT increases the additive noise at the receiver and therefore degrades the signal to noise ratio (SNR). NEXT may be the most significant impediment to effective data transfer because the high-energy signal from an adjacent line can induce relatively significant crosstalk into the primary signal. A second form of crosstalk is far end crosstalk (FEXT) which arises due to capacitive and inductive coupling between the source and victim electrical devices at the far end or opposite end of the transmission path. FEXT is typically less of an issue because the far end interfering signal is attenuated as it traverses the loop.

Another major source of distortion for high speed signal transmission may be mismatch of transmission impedances. As the signal travels along transmission media, various interconnections are generally encountered. Each interconnection has its own internal impedance relative to the traveling signal. For UTP cabling, the transmission media impedance is generally 100 Ohms. Any offsets or differences in impedance values from connecting devices will produce signal reflections. Generally, signal reflections reduce the amount of transmitted signal energy to the receiver and/or distort the transmitted signal. Thus, signal reflections can lead to an undesirable increase data loss.

To accommodate higher frequency data communications, commercially available connection systems generally include compensation functionality that is intended to compensate for electrical noise, e.g., noise/crosstalk introduced in the connection assembly or assemblies. Since demands on networks using UTP systems (e.g., 100 Mbit/s, 1200 Mbit/s transmission rates and higher) have increased, it has become necessary to develop industry standards for higher system bandwidth performance. What began as simple analog telephone service and low speed network systems, has now become high speed data systems. As the speeds have increased, so has the noise.

The ANSI/TIA/EIA 568A standard defines electrical performance for systems that operate in the 1-100 MHz frequency bandwidth range. Exemplary data systems that utilize the 1-100 MHz frequency bandwidth ranges are IEEE Token Ring, Ethernet10Base-T and 100Base-T systems. Five performance categories have been defined by ANSI/TIA/EIA-568.2-10 and the subsequent ANSI/TIA/EIA-568B.2 promulgations, as shown in the Table 1 below. Compliance with these performance standards are used, inter alia, to identify cable/connector quality.

TABLE 1

| Category | Characteristic Specified up to Frequency (MHz) | Exemplary Uses |
|---|---|---|
| 5 | 100 | TP-PMD, SONet, OC-3 (ATM), 100BASE-TX. |
| 5e | 100 | 10-100BASE-T. |
| 6 | 250 | 100-1000BASE-T. |
| 6A | 500 | 1000-10GBASE-T. |

UTP cable standards are also specified in the EIA/TIA-568 Commercial Building Telecommunications Wiring Standard, and such standards include electrical and physical requirements for UTP, STP, coaxial cables and optical fiber cables. For UTP, the requirements include (i) four individually twisted pairs per cable, (ii) each pair has a characteristic impedance of 100 Ohms+/−15% (when measured at frequencies of 1 to 100 MHz); and (iii) 24 gauge (0.5106-mm-diameter) or optionally 22 gauge (0.6438 mm diameter) copper conductors are specified. Additionally, the ANSI/TIA/EIA-568 standard specifies the color coding, cable diameter and other electrical characteristics, such as the maximum crosstalk (i.e., how much a signal in one pair interferes with the signal in another pair—through capacitive, inductive and other types of coupling).

The Category 5 cabling systems provided sufficient NEXT margins to allow for the high NEXT that occurs when using the present UTP system components. However, the demand for higher frequencies, more bandwidth and improved system performance (e.g., Ethernet 1000Base-T) for UTP cabling systems required enhanced system design/performance. More particularly, the TIA/EIA Category 6 standard extended performance requirements to frequency bandwidths of 1 to 250 MHz, requiring minimum NEXT values at 100 MHz to be −39.9 dB and −33.1 dB at 250 MHz for a channel link, and minimum NEXT values at 100 MHz to be −54 dB and −46 dB at 250 MHz for connecting hardware. The increased bandwidth accommodated by the Category 6 standard required increased focus on noise compensation.

More recently, the TIA/EIA 568 Category 6A addendum 10 or EIA568B.2-10 for a new Augmented Category 6 cabling standard extends performance requirements to still higher frequencies, i.e., frequency bandwidths of 1 to 500 MHz. More particularly, the addendum specifies (i) minimum NEXT values at 100 MHz to be −39.9 dB and −26.1 dB at 500 MHz for a channel link, and (ii) minimum NEXT values at 100 MHz to be −54 dB and −34 dB at 500 MHz for connecting hardware. The requirements for Return Loss for a channel are −12 dB at 100 MHz and −6 dB at 500 MHz, and for a connector the corresponding requirements are −28 dB at 100 MHz and −14 dB at 500 MHz.

As noted above, a key element for compensation of NEXT and FEXT is the design and operation of the electrical interface, e.g., the electrical communication between jack and plug connectors. The standard modular jack housing is configured and dimensioned in compliance with the FCC part 68.500 standard which provides compatibility and matability between various media manufacturers. The standard FCC part 68.500 style for modular jack housing which does not add compensation methods/functionality to reduce crosstalk. This standard modular jack housing provides a straightforward approach/design and, by alignment of lead frames in a parallel, uniform pattern, high NEXT and FEXT are generally produced for certain adjacent wire pairs. More particularly, the standard FCC part 68.500 modular jack housing connector defines two lead frame section areas. Section one defines a matable area for electrical plug contact and section two is the output area of the modular jack housing. Section one aligns the lead frames in a parallel, uniform pattern from lead frame tip to the bend location that enters section two, thus producing relatively high NEXT and FEXT noises. Section two also aligns the lead frames in a parallel, uniform pattern from lead frame bend location to lead frame output, thus producing/allowing relatively high NEXT and FEXT noises.

There have been efforts aimed at reducing crosstalk through modified housing designs. For example, U.S. Pat. No. 6,139,371 to Troutman et al. discloses a communication connector assembly having a base support and first and second pairs of terminal contact wires with base portions mounted on the base support. The free end portions of the contact wires define a zone of contact within which electrical connections are established with a mating connector, and each pair of contact wires defines a different signal path in the connector assembly. The first and the second pair of contact wires have corresponding leading portions extending from the free end portions to a side of the zone of contact opposite from the base portions. A leading portion of a contact wire of the first pair and a leading portion of a contact wire of the second pair are constructed and arranged for capacitively coupling to one another, thus conveying capacitive crosstalk compensation to the zone of contact where offending crosstalk is introduced by a mated connector. The additional coupling of the Troutman '371 patent is inadequate in reducing crosstalk to a required degree because, inter alia, the elongated plates are crossed/overlapped and also adjacent, thus creating unwanted parallelisms between contacts 3 to 4 and contacts 5 to 6 and undesirably increasing crosstalk noises. Although crosstalk noise may be reduced by the design of the Troutman '371 patent, the effective complex modes of coupling are more than doubled which potentially increases NEXT, FEXT and noise variation factors.

A similar approach to crosstalk reduction is disclosed in U.S. Pat. No. 6,332,810 to Bareel. The Bareel '810 patent discloses an electrical connector having irregular bends the lead frames and coupling plates defined on contacts 1, 3, 4, 5, 6 and 8. With reference to FIGS. 1 and 2, the coupling plates are vertically arranged relative to the housing and are connected to spring beam contact portions of the terminals. The plates are allowed to slide in grooves formed in the jack housing based on the displacement of the contact portions. Although crosstalk noise may be reduced by the design of the Bareel '810 patent, spring beam contacts can undesirably increase unwanted coupling due to their lengths. In addition, forming lead frames in the manner disclosed by the Bareel '810 patent results in complex effective modes of coupling that are more than tripled, thereby potentially increasing NEXT and/or FEXT variation factors.

Another similar approach to reducing crosstalk noises associated with a modular jack housing is disclosed in U.S. Pat. No. 6,409,547 to Reede. The Reede '547 patent discloses an electrical connector that includes bent cantilever spring beams having ends that are electrically connected to capacitive plates. Although crosstalk noise may be reduced, spring beam contacts can increase unwanted coupling due to their lengths.

U.S. Pat. No. 6,176,742 to Arnett et al. discloses an electrical connector that provides capacitive crosstalk compensation coupling in a communication connector by the use of a capacitor compensation assembly. One or more crosstalk compensation capacitors are supported in the housing. Each compensation capacitor includes a first electrode having a first terminal, a second electrode having a second terminal, and a dielectric spacer disposed therebetween. The terminals of the electrodes are exposed at positions outside of the housing so that selected terminal contact wires of the connector make electrical contact with corresponding terminals of the compensation capacitors to provide capacitive coupling between the selected contact wires when the contact wires are engaged by a mating connector. Of note, a design of the type disclosed in the Arnett '742 patent can undesirably decrease contact flexibility, thereby adds complexity to design efforts. In addition, utilizing a curved spring beam contact design can increase unwanted NEXT/FEXT noises because of the adjacencies between pairs.

U.S. Pat. No. 6,443,777 to McCurdy et al. discloses a communication jack having a first and second pairs of contact wires defining corresponding signal paths in the jack. Parallel, co-planar free end portions of the wires are formed to connect electrically with a mating connector that introduces offending crosstalk to the signal paths. First free end portions of the first pair of contact wires are supported adjacent one another, and second free portions of the second pair are supported adjacent corresponding ones of the first free end portions. Intermediate sections of the first pair of contact wires diverge vertically and traverse one another to align adjacent to corresponding intermediate sections of the second pair of wires to produce inductive compensation coupling to counter the offending crosstalk from the plug. Capacitive compensation coupling may be obtained for the contact wires via one or more printed wiring boards supported on or in the jack housing.

Another method for crosstalk noise reduction and control in connecting hardware is addressed in commonly assigned U.S. Pat. No. 5,618,185 to Aekins. A connector for communications systems includes four input terminals and four output terminals in ordered arrays. A circuit electrically couples respective input and output terminals and cancels crosstalk induced across adjacent connector terminals. The circuit includes four conductive paths between the respective input and output terminals. Sections of two adjacent paths are in close proximity and cross each other between the input and output terminal. At least two of the paths have sets of adjacent vias connected in series between the input and output terminals. The subject matter of the Aekins '185 patent are hereby incorporated by reference.

Alternative conductor layouts for purposes of jack/plug combinations have been proposed. For example, U.S. Pat. No. 6,162,077 to Laes et al. and U.S. Pat. No. 6,193,533 to De Win et al. disclose male/female connector designs wherein shielded wire pairs are arranged with a plurality of side-by-side contacts and additional contact pairs positioned at respective corners of the male/female connector housings. The foregoing arrangement of contacts/contact pairs for shielded cables is embodied in an International Standard—IEC 60603-7-7—the contents of which are hereby incorporated herein by reference. The noted IEC standard applies to high speed communication applications with 8 position, pairs in metal foil (PIMF) shielded, free and fixed connectors, for data transmissions with frequencies up to 600 MHz.

Despite efforts to date, a need remains for connector designs that reliably and effectively address the potential for crosstalk noise, e.g., at higher transmission frequencies. In addition, a need remains for connector designs that accommodate plugs of varying design/contact layout. Still further, a need remains for connector designs that compensate for crosstalk without adding undue complexity and/or potential cost to the connector design and/or manufacture. Moreover, a need remains for connector designs that accommodate and/or facilitate the introduction or non-introduction of compensation as may be desired based on variable factors encountered in use, e.g., different plug designs and/or plugs having differing contact layouts.

These and other needs are satisfied by the systems and connector designs disclosed herein, as will be apparent from the detailed description which follows, particularly when read in conjunction with the figures appended hereto.

SUMMARY

The present disclosure is directed to advantageous modular insert assemblies and, more particularly, to modular insert assemblies that include bi-sectional contacts that allow interrupted communications across individual contacts, e.g., based upon interaction with corresponding plug contacts. According to exemplary embodiments of the present disclosure, lead frame wires or contacts having split, bi-sectional or dual forms are positioned in a connector housing, e.g., a jack housing, so as to accommodate electrical interface with contacts in a connecting assembly, e.g., a plug. The split/bi-sectional lead frame wires/contacts may feature desired geometries, e.g., through bending or the like, so as to reduce noise and rebalance the signal pairs in a simple and low cost manner, and without altering the impedance characteristics of the wire pairs.

In an exemplary embodiment of the present disclosure, a modular dielectric insert for a modular jack housing for use in data/voice communication systems is provided. The disclosed insert advantageously functions to reduce NEXT and FEXT. Moreover, the disclosed insert allows optional contact between bi-sectional/split contacts associated therewith, thereby controlling compensation introduction and/or delivery based on, inter alia, the design/layout of an associated plug to be associated therewith. Thus, the disclosed insert allows and/or facilitates optional delivery of compensation based on multiple preformed reactance parameters within the split wire paired units.

In exemplary embodiments, the disclosed telecommunication connector system is designed to optionally reduce electro magnetic interference from an adjacent transmitter. The optional reduction of EMI is achieved through connecting hardware design. The internal contacts are isolated and split into two-sectional design. Internal EMI line reduction is allowed/introduced only when the two sectional contacts are electrically mated by an outside source. By isolating the contact sections in the interface system, the coupled signal for EMI balance is optionally utilized in a low cost and manufacturable design. Thus, the disclosed split/bi-sectional design functions as an internal passive switch method for the introduction of signal noise balancing as and when appropriate.

The disclosed bi-sectional/split contact design also provides reliable functionality over an extended period. Thus, for example, a modular jack dielectric insert device that includes the disclosed bi-sectional/split contact design, e.g., for use in data/voice systems, reduces the potential for wire pair deformation, e.g., in a standard EIA T568B style wire configuration. Each of the bi-sectional/split contact members advantageously define elongated cantilever members that are supported by the jack housing, with the cantilevered portions thereof extending into a spaced, side-by-side position. Deflection of one or both cantilevered members is effective to complete a circuit associated with the bi-sectional/split contact members. Such deflection is generally effectuated through introduction of a plug into the jack housing, with bi-sectional contacts being brought into contact only insofar as the plug has a contact member that is brought into alignment/contact with a particular bi-sectional/split contact. The design is thus simple, low cost and easy to implement into a modular housing.

In an exemplary embodiment, the disclosed insert is positioned within a modular jack housing such that the associated contacts are positioned for electrical communication with data signal transmission media plug elements/contacts introduced to the receiving space of the jack housing. The insert generally includes a dielectric support member having a plurality of pairs of substantially straight elongated contact members positioned in contact therewith. One or more of the substantially straight, elongated members are split into two separated and initially electrically open contacts. The front end section(s) of the split/bi-sectional contact(s) are typically substantially straight, elongated members that have a front end portion which includes a contact portion that is exposed in the receiving space of the modular housing for making electrical contact with the media plug contacts.

The front end sections of one or more of the split/bi-sectional contact(s) also advantageously communicate with a capacitive coupling section. The capacitive coupling section may take a variety of forms. Thus, in a first exemplary embodiment, the capacitive coupling section takes the form of capacitive plates in a side-by-side position/orientation that are in electrical communication with transmission media requiring compensation. In a second exemplary embodiment, the capacitive coupling section may take the form of interdigitated fingers/extensions in electrical communication with transmission media requiring compensation. In a further exemplary embodiment, the capacitive coupling region may be defined on a printed circuit board (PCB) in electrical communication with transmission media requiring compensation. Thus, the PCB may feature closely aligned traces, via's, interdigitated stub regions and/or ancillary electronic components (e.g., capacitors) for effecting a desired level of compensation.

The rear end section of exemplary split/bi-sectional contacts according to the present disclosure generally include an electrically conductive connector device/region for connecting and transmitting a signal to other devices. Thus, for example, the rear end sections may define or cooperate with extensions that are adapted to engage a printed circuit board (PCB) or otherwise communicate with associated devices/assemblies.

Thus, in one aspect in accordance with the present disclosure, the pluralities of pairs of elongated members have substantially multilaterally symmetrical portions and substantially multilaterally asymmetrical portions. In another aspect, the internal contacts are isolated and split into a two-sectional design. By isolating or splitting each contact section in the interface system, the coupled signal for EMI balance is optionally implemented by and based upon the modular plug that is inserted for electrical connection. In a further aspect, the front end portions of the front section elongated conductive members are in electrical communication with frontal capacitive coupling functionality that is preformed and/or combined therewith, the capacitance field defined thereby functioning to rebalance and/or reduce crosstalk associated with central pair contact combinations.

In another aspect in accordance with the present disclosure, each pair of the plurality of pairs of elongated members includes a ring member and a tip member. The ring and tip members may be separated so that the ring members are on the same plane, that is, in one row, and the tip members are in another row. Preferably, these rows of conductors are spaced apart.

Preferably, the disclosed insert is used in a modular jack that is adapted to receive and compensate signals transmitted through the eight leads from plugs of differing design/layout. Thus, the disclosed insert/jack is first adapted to receive and compensate signals from a standard RJ45 plug. The EIA T568B has eight positions numbered 1-8 which are paired as follows: 1-2 (pair 2), 3-6 (pair 3), 4-5 (pair 1), 7-8 (pair 4). For the EIA T568B or T568A style configurations of category 6 and 6A UTP cabling, and most others, there are also eight positions. Thus, there are eight elongated conductive elements disposed on the dielectric support member. Again, each front end section of each bi-sectional/split element has a front portion with a contact portion for establishing electrical contact with one of the eight leads. Such contact causes deflection of the front end section into electrical communication with the rear end section of the bi-sectional/split contact. The rear end sections are generally adapted to effect further transmission of the signal from the front end to the terminal end.

Exemplary embodiments of the disclosed insert/jack are also advantageously adapted to receive and compensate signals from a plug that is configured according to the IEC 60603-7-7 standard (see, e.g., U.S. Pat. Nos. 6,162,077 and 6,193,533). In such plug design, pairs of contacts are positioned substantially in the four corners thereof. To accommodate such plug design, the disclosed jack includes eight (8) bi-sectional/split contacts in side-by-side alignment so as to accommodate an RJ-45 plug (as described above), and an additional two (2) pairs of contacts in opposed/spaced corners of the jack that are adapted to cooperate with corresponding contacts formed in the noted plug. Thus, when a plug that is compliant with the IEC 60603-7-7 standard is introduced to the disclosed jack, the central four (4) bi-sectional/split contacts of the eight side-by-side contacts do not make contact with corresponding contacts within the plug.

The dual functionality of the disclosed jack, i.e., the ability to automatically accommodate plugs of differing contact layout, is particularly advantageous. Of note, but for the bi-sectional/split contact arrangement of the disclosed insert/jack, the central pairs would contribute/introduce compensation to the circuit by reason of the capacitive plates/interdigitated fingers/PCB compensation in communication with the front ends thereof. However, by reason of the bi-sectional/split contact design disclosed herein, such compensation does not arise and the compensation functionality is effectively isolated from the transmission media when and to the extent a plug does not include an aligned contact for a bi-sectional/split contact within the jack.

These conductive elements are arranged in a positional relationship with respect to each other for forming a capacitance to compensate electrical noise during transmission of the signal. The positional relationship may involve having the front portions of the eight conductive elements with dual coupling sections in a substantially parallel alignment along two longitudinal axes, and having the rear portions include parallel portions as well as portions transverse to the longitudinal axis.

According to the present disclosure, an arrangement for compensating crosstalk noise is provided that includes a dielectric modular jack housing having a signal transmission media receiving space for receiving signal transmission media having a plurality of conductive members, such as a UTP cable and plugs. Pluralities of pairs of conductors are disposed in the signal transmission media receiving space. The conductors are split into two halves/portions, front and rear end contact sections. The front end contact section is adapted to mate with, i.e., make electrical contact with, a contact of a mating plug. In addition, upon mating with a plug having an aligned contact, the front end portion and the rear end portion are brought into electrical contact, e.g., based on deflection of at least the front end portion into contact with the rear end portion.

For compensation purposes, once a forward location of the rear end section is brought into electrical contact with the front end portion, e.g., based on deflection as described herein, the rear end section (and the transmission media as a whole) receives compensation signal(s) from the compensation region associated with the front end portion, e.g., from compensation functionality associated with a printed circuit board ("PCB") in communication with the front end portion.

In accordance with exemplary embodiments of the present disclosure, the elongated conductors positioned within the jack housing may be placed in a positional relationship with respect to each other to impart a capacitance effect for compensating electrical noise in a signal transmission. The capacitive positional relationship may involve, inter alia, the front end portions being substantially parallel with respect to each other along two longitudinal axes, with each section being non-adjacent to each other. Alternatively or in addition, the rear end portions may be partially parallel to form another coupling section (and partially transverse with respect to the axis).

These and other unique features of the disclosed systems, apparatus and methods will become more readily apparent from the following description, particularly when read in conjunction with the appended figures.

BRIEF DESCRIPTION OF THE DRAWINGS

So that those having ordinary skill in the art to which the subject disclosure appertains will more readily understand how to construct and employ the systems, apparatus and methods of the subject disclosure, reference may be had to the drawings wherein.

DESCRIPTION OF EXEMPLARY EMBODIMENT(S)

Figure 1:
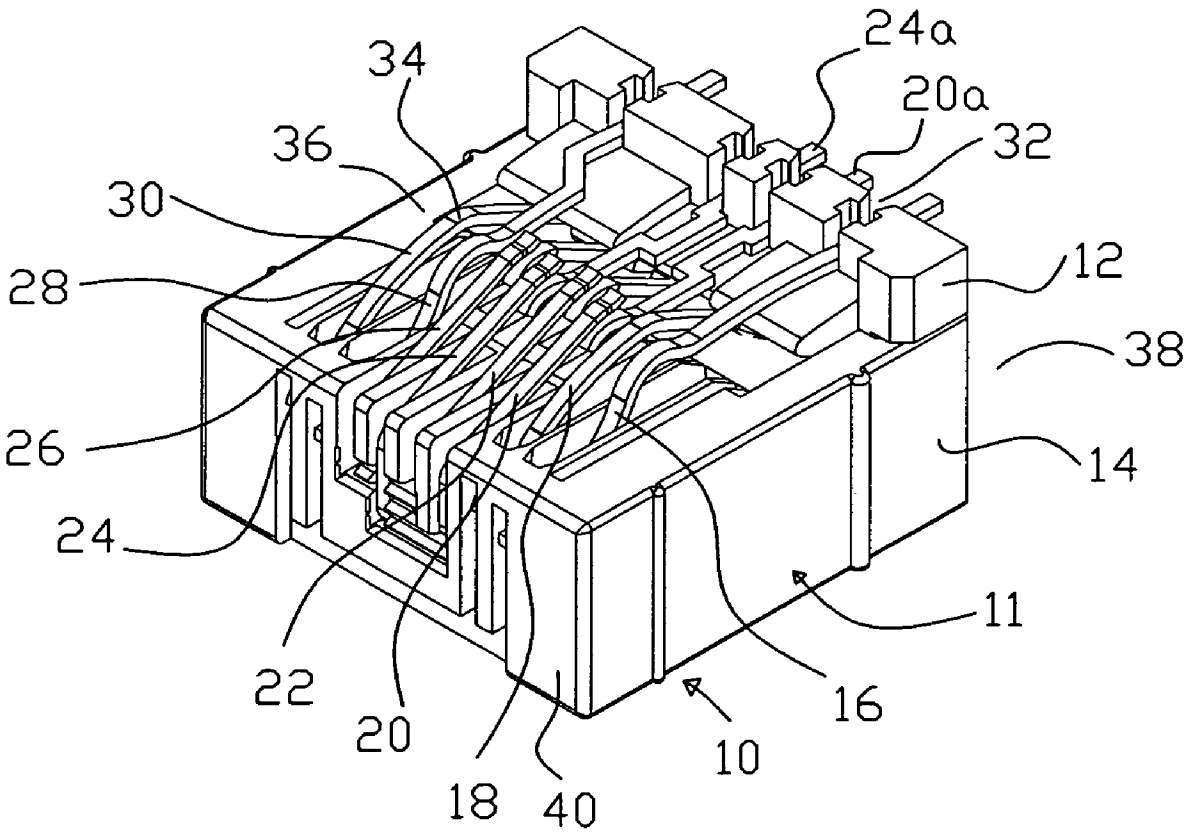
FIG. 1 is a perspective view of an exemplary insert device in accordance with a first embodiment of the present disclosure.

The present disclosure provides advantageous modular insert assemblies for use in voice/data communication systems. The present disclosure also provides jack assemblies that include such insert assemblies, and jack/plug combinations that benefit from the advantageous structures, features and functions disclosed herein. In addition, the present disclosure provides methods for effecting voice/data communications wherein modular insert assemblies, jacks containing the disclosed insert assemblies and/or jack/plug combinations as described herein, are advantageously employed.

The disclosed modular insert assemblies include one or more bi-sectional contacts that define two distinct states: (i) an "open" state where the front end portion of a bi-sectional contact is spaced from and not in electrical communication with a rear end portion of such bi-sectional contact, and (ii) a "closed" state where the front end portion of the bi-sectional contact is in contact with, and therefore in electrical communication with, the rear end portion of such bi-sectional contact. The front and rear end portions are advantageously mounted with respect to an underlying insert member such that the "open" state is maintained unless and until a plug having an aligned contact is brought into engagement with a jack containing such insert assembly.

The disclosed bi-sectional/split contact design provides reliable functionality over an extended period by, inter alia, reducing the potential for wire pair deformation, e.g., in a standard EIA T568B style configuration. Each of the bi-sectional/split contact members advantageously define elongated cantilever members that are supported by the insert and/or jack housing, with the cantilevered front end and rear end portions thereof extending into a spaced, side-by-side (i.e., "open" state) position. Deflection of one or both cantilevered members is effective to complete a circuit associated with the bi-sectional/split contact members, e.g., through engagement with a corresponding plug contact.

The bi-sectional/split contacts generally take the form of lead frames, although the present disclosure is not limited to lead frame implementations. In exemplary embodiments wherein the bi-sectional/split contacts are fabricated as lead frames, such lead frames are typically positioned in an insert member for subsequent positioning in a jack housing. Once assembled in a jack housing, the bi-sectional contacts/lead frames facilitate electrical interface and communication with contacts in a connecting assembly, e.g., a plug. Noise reduction may be provided by the geometric features and/or positional relationship of individual lead frames, as is known in the art. In addition, pairs of lead frame members are typically associated with capacitive structure(s) to provide further noise reduction and/or compensation.

The disclosed insert is typically positioned within a modular jack housing such that the associated contacts/lead frames are positioned for electrical communication with data signal transmission media plug elements/contacts introduced to the receiving space of the jack housing. The insert generally includes a dielectric support member in which a plurality of pairs of substantially straight, elongated contact members/lead frames are positioned. As noted herein, one or more of the contact members/lead frames define bi-sectional/split structures that each include a front end portion and a rear end portion. The front end portions/sections of one or more of the split/bi-sectional contact(s) also advantageously communicate with a capacitive structure, e.g., a capacitive coupling section. The rear end portions may also communicate with a printed circuit board (PCB) that includes compensation functionality, e.g., capacitively aligned traces, capacitive stub regions, capacitively positioned via's, or the like.

The capacitive coupling section in communication with the front end portions of the bi-sectional contacts/lead frames may take a variety of forms, e.g., capacitive plates in a side-by-side position/orientation, interdigitated fingers/extensions and/or a printed circuit board (PCB) that includes closely aligned traces, capacitively positioned via's, interdigitated stub regions, and/or ancillary electronic components (e.g., capacitors).

The disclosed insert is advantageously used in a modular jack that is adapted to receive and compensate signals transmitted through the eight leads from plugs of differing design/layout. Thus, the disclosed insert/jack is first adapted to receive and compensate signals from a standard RJ45 plug. The disclosed insert/jack is also advantageously adapted to receive and compensate signals from a plug that is configured according to the IEC 60603-7-7 standard (see, e.g., U.S. Pat. Nos. 6,162,077 and 6,193,533). Based on the significant spacing of contact pairs according to the IEC 60603-7-7 standard, crosstalk is substantially reduced. Thus, lesser amounts of compensation are required for plug/jack assemblies according to the IEC 60603-7-7 standard as compared to a conventional RJ-45 plug/jack combination.

The disclosed insert/jack design is advantageously adapted to deliver an appropriate level of compensation, regardless of the contact arrangement of the plug (i.e., whether the plug features an RJ-45 alignment or a contact arrangement according to the IEC 60603-7-7 standard). Thus, when an RJ-45 plug is inserted/combined with a disclosed insert/jack, all eight (8) bi-directional contacts/lead frames deflect to the "closed" state, thereby drawing upon the capacitive structure (s) in communication with the front end portions of appropriate lead frames/contacts, e.g., the central four (4) lead frames/contacts. Conversely, when a plug that is compliant with the IEC 60603-7-7 standard is introduced to the disclosed jack, the central four (4) lead frames/contacts do not make contact with corresponding contacts within the plug. As such, the capacitive structure(s) in communication with the front end portions thereof are isolated from the circuit, and the only compensation delivered to the central four (4) lead frames/contacts is that compensation associated with the PCB in communication with the rear end portions of such lead frames/contacts. The dual functionality of the disclosed jack, i.e., the ability to automatically accommodate plugs of differing contact layout, is particularly advantageous.

Referring now to the drawings, FIGS. 1-12 illustrate first embodiments of a dielectric interface modular insert 10 in accordance with the present disclosure. Insert 10 defines a housing member 11 that includes an upper portion 12 seated on a lower portion 14, with at least the rear portions of eight (8) electrically conductive lead frames 16, 18, 20, 22, 24, 26, 28 and 30 disposed therebetween. Preferably, upper portion 12 and lower portion 14 are constructed of a low dielectric material, such as a plastic material.

Insert 10 supports the eight (8) lead frames in accordance with most standard wiring formations, thereby accommodating RJ45 plugs according to as the T568B and T568A standards. The TIA/EIA commercial building standards have defined category 5e to 6A electrical performance parameters for higher bandwidth (100 up to 500 MHz) systems. In category 5e and 6A, the TIA/EIA RJ45 wiring style is currently preferred and is followed throughout the cabling industry. However, as described in greater detail below, a jack that receives insert 10 according to the present disclosure includes an additional two (2) pairs of contacts in opposed corners, thereby also accommodating plugs having contact geometries in compliance with the IEC 60603-7-7 standard. Such additional contact pairs are generally not supported by insert 10, although alternative insert geometries may be developed/adopted to accommodate twelve (12) lead frame/contact pairs in the alignment schematically depicted in FIG. 18 without departing from the spirit or scope of the present disclosure.

Figure 9:
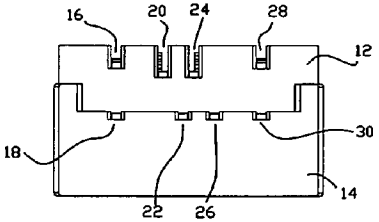
FIG. 9 is a rear plan view of an exemplary embodiment of the present disclosure.

The rear sections of lead frames 16 through 30 are thus engaged or captured in channel slots 32. In an exemplary embodiment of the present disclosure, such engagement/capture is effectuated through interaction between T-shaped cut outs 32 formed in upper portion 12 and/or lower portion 14 to receive corresponding T-shaped features (see, e.g., T-shaped portions 20*a*, 24*a* in FIG. 2) formed on the rear end portions of the lead frames. The interaction between the T-shaped cut outs 32 and associated T-shaped portions on the lead frames (or such other cooperative structural arrangement as may be employed according to the present disclosure) is generally effective to support bi-sectional/split lead frames of the present disclosure in a cantilevered manner. Such interaction also supports and aligns the lead frames 16 through 30 in position prior to being inserted into a PCB (not pictured). In particular, in an exemplary embodiment of the present disclosure, lead frames 16, 20*a*, 24*a* and 28 are associated with slots/passages in upper portion 12 and lead frames 18, 22*a*, 26*a* and 30 are associated with slots 32 in lower portion 14. As shown in FIG. 9, the eight (8) lead frames thus define two substantially parallel planes as they exit insert housing member 11 at a rear side thereof.

Figure 2:
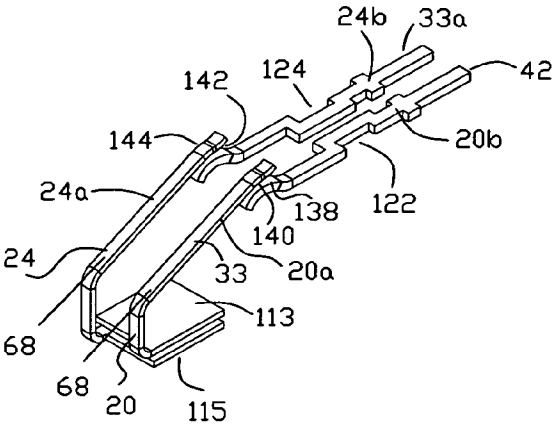
FIG. 2 is perspective view of exemplary lead frames and associated capacitive structure according to a first embodiment of the present disclosure.
Figure 3:
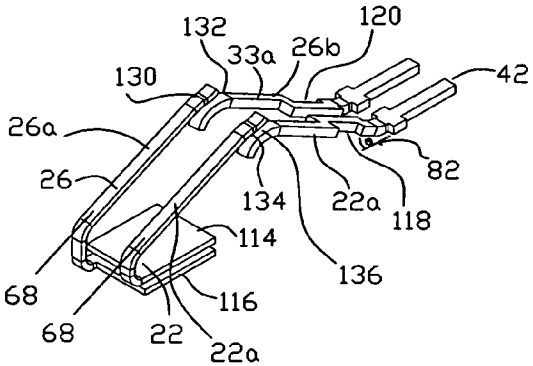
FIG. 3 is perspective view of further exemplary lead frames and associated capacitive structure according to a first embodiment of the present disclosure.

With reference to FIGS. 1-3, the central four (4) lead frames of the disclosed embodiment feature a bi-sectional or split lead frame geometry. Thus, with reference to FIG. 2, lead frame 24 is defined by a front end portion 24*a* and a rear end portion 24*b*. Similarly, lead frame 20 is defined by a front end portion 20*a* and a rear end portion 20 *b*. With reference to FIG. 3, lead frame 26 is defined by front end portion 26*a* and rear end portion 26*b*, and lead frame 22 is defined by front end portion 22*a* and 22*b*. In an initial position, i.e., before introduction of a plug having aligned contacts, each of the front end portions 20*a*, 22*a*, 24*a*, 26*a*, are in a spaced orientation relative to rear end portions 20*b*, 22*b*, 24*b*, 26*b*. This initial spaced orientation is best seen with reference to the side views of FIGS. 5-7. As described herein, the spacing between front and rear end portions prior to contact with a plug having aligned contacts effects an "open" state wherein capacitive structure(s) in communication with the front end portions of the lead frames are electrically isolated from the transmitted signals.

With reference to FIG. 2 and the exemplary capacitive structures depicted therein, the front end portions 20*a*, 24*a* of lead frames 20, 24 are in communication with capacitive structures, namely metallic pads/plates 113 and 115, respectively. Metallic pads/plates are in spaced, parallel alignment at a capacitive distance, e.g., about 0.012 inches apart. In exemplary embodiments of the present disclosure, capacitive pads/plates 113, 115 may be electrically isolated by utilizing spray dielectric coating materials, by an additional dielectric material between the two pads or combinations thereof. With reference to FIG. 3, the front end portions 22*a*, 26*a* of lead frames 22, 26 are also in electrical communication with metallic pads/plates 114 and 116, respectively, which are spaced by a capacitive distance (e.g., about 0.012 inches). These contacts pads/plates may also be electrically isolated, e.g., by utilizing spray dielectric coating materials, an additional dielectric spacer between the two pads, or combinations thereof.

In exemplary embodiments of the present disclosure, the capacitive pads/plates 113, 115 associated with lead frames 20, 24 may be positioned slightly below the capacitive pads/plates 114, 116 associated with lead frames 22, 26 so as to reduce and/or avoid unwanted stray capacitive coupling. Insert housing 11 advantageously functions to maintain each of the capacitive pads/plates 113, 114, 115, 116 in a desired vertical and horizontal orientation, thereby ensuring proper capacitive functionality for the disclosed capacitive structures.

The design and operation of capacitive pads/plates 113-116 to deliver an appropriate level of compensation to insert 10 is within the skill level of ordinary practitioners in the field. The capacitive contributions from capacitive pads/plates 113-116 must be balanced with other compensation contributors associated with the overall design and operation of the disclosed jack. Thus, for example, any compensation generated by the PCB in electrical communication with the rear end portions and/or compensation generated by geometric arrangement of the lead frames as they traverse insert 10 must be considered in sizing and orienting capacitive pads/plates 113-116 so as to offset the noise introduced by reason of the plug/jack interconnection.

Lead frames 16 through 30 traverse insert 10 from outer end 38 to inner end 40 and, for a portion of the distance, may be substantially parallel with respect to each other. According to the exemplary embodiments of the present disclosure, outer lead frame pairs 16, 18 and 28, 30 define continuous structures, i.e., lead frames 16, 18, 28, 30 are not bi-sectional/split lead frames. However, in alternative embodiments, such outer lead frame pairs may be fabricated as bi-sectional/split lead frames without departing from the spirit or scope of the present disclosure. In such circumstance, to the extend ancillary components and/or circuitry is in electrical communication with front end portions of the bi-sectional, outer lead frame pairs, such ancillary components and/or circuitry would be isolated from the circuit and/or signals traveling on such outer lead frame pairs unless and until a "closed" state was effected.

Outer lead frame pairs 16, 18, 28, 30 are elongated contacts with curved or bent body portions that define upstanding contact portions for effecting electrical contact with an inserted plug. The contact portions may be bowed or otherwise upwardly extending so as to facilitate effective electrical contact with corresponding contacts formed in a plug. Connector pins extend from the inner end of all lead frames, including specifically outer lead frame pairs 16, 18, 28,30, to permit mating of such lead frames with other components or cables, e.g., a PCB. In the contact region, all lead frames 16 through 30 are typically aligned in a substantially parallel, spaced orientation so as to facilitate electrical communication/engagement with a plug's contacts, e.g., an RJ45 plug of the type schematically depicted in FIG. 14. Thus, the first pair of a T568B four-paired plug would align with lead frames 22 and 24, the second pair with lead frames 16 and 18, the third pair with lead frames 20 and 26, and the fourth pair with lead frames 28 and 30.

As noted previously, the central lead frame pairs 20, 22, 24, 26 are split into two sections according to exemplary embodiments of the present disclosure. Based on the forces to be encountered when a plug is inserted (or withdrawn) from a jack containing insert 10, the front end portions 20*a*, 22*a*, 24*a*, 26*a* generally overlay the corresponding rear end portions 20*b*, 22*b*, 24*b*, 26*b*. Upon mating with a plug that includes aligned contacts, the front end portions 20*a*, 22*a*, 24*a*, 26*a* of lead frames 20, 22, 24, 26 are deflected downward into contact/engagement with rear end portions 20*b*, 22*b*, 24*b*, 26*b*, thereby establishing electrical communication therebetween. In this way, the capacitive structures, i.e., capacitive pad/plate pairs 113, 115 and 114, 116, are energized and generate compensation signals for delivery to lead frame contacts 20, 22, 24, 26.

Referring again to FIG. 1, upper portion 12 may include a curved support ramp which extends under a portion of lead frames 16, 20, 24, 28 for, among other things, supporting and increasing the flexibility of the lead frames. Similarly, lower portion 14 may further include a ramped support portion which extends under a portion of lead frames 18, 22, 26, 30. Channel guides may also be provided within insert housing member 11, e.g., to guide and support the lead frames 16, 18, 20, 22, 24, 26, 28, 30 as they traverse insert 10. The spacing of lead frames, e.g., at end 40, may be selected so as to minimize potential crosstalk noise. Thus, for example, in upper portion 12, the distance between lead frames 28 and 24 may be about 0.190 inch, between lead frames 24 and 20 may range from about 0.050 to 0.060 inches, and between lead frames 20 and 16 may be about 0.1 inch. In the lower portion, the distance between lead frames 30 and 26 may be about 0.1 inch, between lead frames 26 and 22 may range from about 0.050 to 0.060 inches, and between lead frames 22 to 18 may be about 0.190 inch. Preferably, the distance between the lower portion lead frames and the upper portion lead frames is at least about 0.1 inch. This arrangement serves to reduce the pair to pair noise, which may be introduced to the system by the TIA/EIA T568B/A plug, among other things.

In exemplary embodiments of the present disclosure, lead frames 30, 26, 22, 18 are designated ring R' (i.e., negative voltage transmission) polarity and lead frames 28, 24, 20, 16 are designated tip T' (i.e., positive voltage transmission) polarity. For T568B category 5e and 6 frequencies, unwanted noise is induced mainly between contacts 26, 24, 22, 20, and minor unwanted noises are introduce between contacts 18 and 20 as well as contacts 26 and 28.

Lead frames 16 through 30 are electrically short in reference to the wavelengths up to 500 MHz. By positioning the capacitive structures, e.g., capacitive pads/plates 113, 115 and 114, 116, in close proximity to the source of the crosstalk noise, the offset regions are reduced. Re-balancing the original signal to remove the noise signal is best achieved by using a signal of opposite polarity than the originating noise signal. The optimal point for creation of a re-balancing signal is within 0.2 inches of the noise creation region because it provides equal magnitude and phase to the original negative noise region, among other things. The disclosed insert assemblies are advantageously effective in satisfying or approaching this desired proximity.

Lead frames 16 through 30 are generally arranged in a manner to reduce unwanted noise via coupling in EIA RJ45 T568B having standard plug positions 1, 2, 3, 4, 5, 6, 7, 8, particularly as compared to standard RJ45 modular inserts. This reduction in unwanted noise generation is achieved, in part, by reducing the degree to which lead frame are maintained in a parallel/adjacent orientation as compared to standard RJ45 modular inserts.

More fundamentally, however, by splitting at least the central lead frame pairs, i.e., lead frames 20, 22, 24, 26, into two distinct, separated portions, the disclosed inserts, jacks and assemblies function effectively whether a plug to be mated with the disclosed insert/jack includes all standard contacts of an EIA RJ45 T568B plug, or does not include such central lead frame pairs, e.g., as is the case with a plug fabricated in accordance with the IEC 60603-7-7 standard. In such case, the center contacts 3, 4, 5, 6 are removed and are repositioned in opposed corner locations and, according to the advantageous bi-sectional/split lead frame design of the present disclosure, the "closed" state is not achieved for such central lead frame pairs. Therefore, the capacitive structures associated with the front end portions of lead frames 20, 22, 24, 26 would not be energized and noise balancing therefrom would not arise. Engagement and energizing of the compensation functionality associated with the lead frames 20, 22, 24, 26 only occurs when the disclosed insert/plug is mated with an EIA RJ45 T568B standard plug (or structurally similar/comparable plug) with positions 1, 2, 3, 4, 5, 6, 7, 8 in use, i.e., occupied by a corresponding contact.

Thus, the bi-sectional/split lead frame design of the present disclosure provides a method for the utilization and automatic accommodation of two different types of plugs, one that is EIA RJ45 T568B and one that is an offset from EIA RJ45 T568B. As noted herein, the offset plug could include contacts 1, 2 and 7, 8 in present EIA RJ45 T568B configuration, but contacts 3, 6 and 4, 5 could be configured in the opposite or different ends as compared to the original slotted locations. If there are no contacts in EIA RJ45 T568B positions 3, 4, 5, 6, then lead frames 20, 22, 24, 26 are not mated and the capacitance composition balancer is automatically not implemented/energized. As such, the capacitive structures associated with the central pairs do not affect the system, which is highly desirable because the system would not require noise balancing therefrom (and any supplied noise balancing would from such capacitive structures would have a deleterious effect on system performance).

FIG. 3 illustrates the capacitive interaction of lead frames 22 and 26. Lead frames 22 and 26 are parallel along longitudinal axis 68 and are angled (or, in an alternative embodiment, curved) upward with respect to insert housing member 11 (not pictured) at an angle 82. Preferably, angle 82 is about 30 degrees so as to, inter alia, provide for the pre-load stress of mating with a plug and increase the lead frame contact force to an estimated 100 grams or more. Associated with the front end portions 22*a*, 26*a* is capacitance balancing functionality in the exemplary form of substantially rectangular metallic pads/plates 114 and 116. When a dielectric substance is positioned between the two pads/plates, a distance of at least 0.011 inches is generally defined therebetween.

The pads/plates 114, 116 are a limited distance from the point of plug mating contact, thereby reducing the NEXT noises that is created from the plug interaction for plug assemblies that contact the central lead frame pairs (so as to energize capacitive pads/plates 114, 116 and 113, 115). An average distance of about 0.213 inches is generally utilized to counterbalance the injected noise, since this is an electrically short distance that produces near instantaneous feedback of balancing noise vectors. The pads 113, 115 are generally configured, dimensioned and deployed so as to produce an estimated 1 pF of capacitance reactance. This parameter is effected, at least in part, by the dielectric material (if any) and the spacing of the pads.

At the opposite ends of the lead frames, i.e., at the far end of rear end portions 12*b*, 26*b*, the lead frames 22, 26 generally engage a printed circuit board (PCB) that generates further capacitance to compensate for noise associated with the plug/jack interaction. In addition, an inductance reactance is effected between lead frames 22, 26 in the adjacent regions 118 and 120, respectively. An average distance of about 0.190 inches may again be utilized to counter balance the undesirably injected noise, since this also is an electrically short distance that produces near instantaneous feedback of balancing noise vectors.

The interaction between the front end portion and the rear end portion of each central lead frame 20, 22, 24, 26 is substantially identical. For illustration purposes, the interaction between the front end portion 22*a* and rear end portion 22*b* of lead frame 22 will be described with reference to FIG. 3. However, it is to be understood that such description applies with equal force to lead frames 20, 24, 26 (and any other lead frames that may be fabricated with a bi-sectional/split configuration as described herein). When engaged by a plug having an aligned contact, the bottom surface 134 of the front end portion 22*a* of lead frame 22 deflects downward and makes electrical contact with the top surface 136 of rear end portion 22*b* of lead frame 22. Depending on the tolerances involved, downward deflection of rear end portion 22*b* may also result. The contact between bottom surface 134 of front end portion 22*a* and the top surface 136 of rear end portion 22*b* is effective to form a continuous signal transmission path when a FCC RJ45 plug is mated. When the plug is withdrawn from the jack containing lead frame 22, the overall rigidity and cantilevered arrangement of the front and rear end portions 22*a*, 22*b* are sufficient to cause upward deflection thereof, thereby reestablishing an "open" state therebetween.

Figure 4:
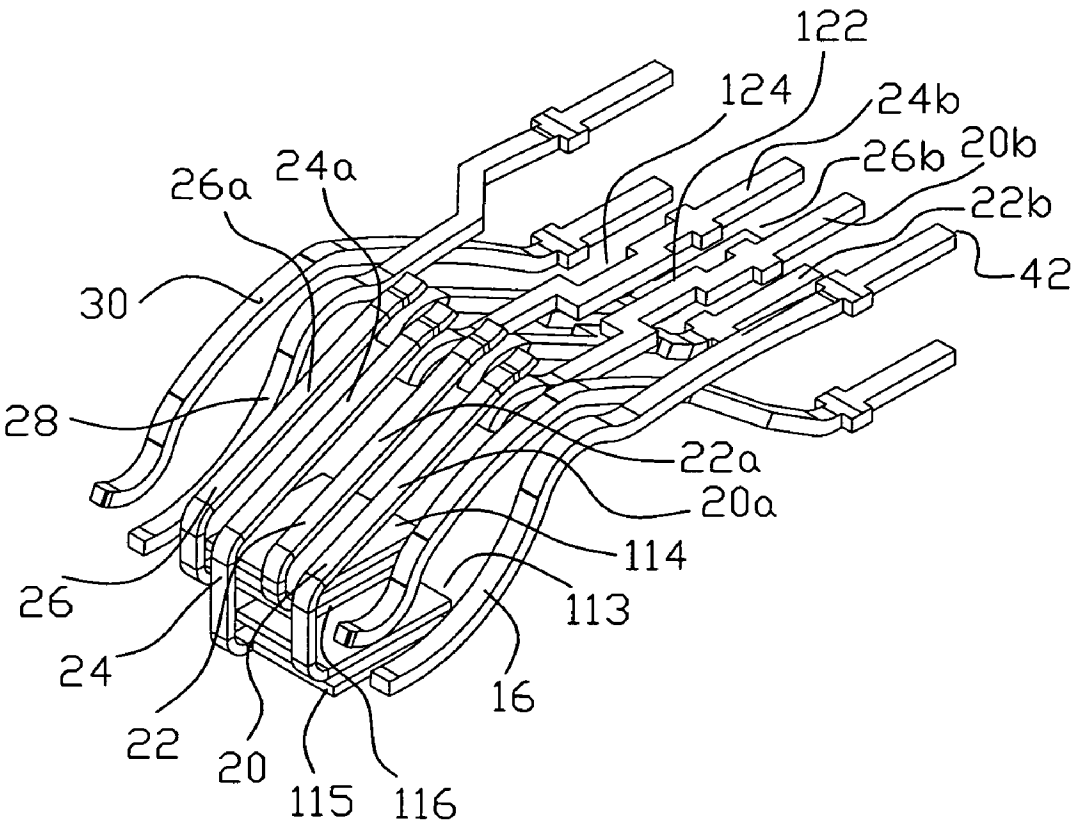
FIG. 4 is perspective view of exemplary lead frames (separated from an underlying housing for ease of viewing) and associated capacitive structure according to a first embodiment of the present disclosure.

FIG. 4 illustrates the combination of the two sets of pins, i.e., the top four pins associated with lead frames 16, 20, 24, 28, and the bottom four pins associated with lead frames 18, 22, 26, 30. The angle of separation between the two sets of pads 113, 115 and 114, 116 is at least 30 degrees or more. As shown in FIG. 4, the inner most pads are associated with differential pair one, i.e., contact sets 22 and 24, which corresponds to the EIA 568-B.2 RJ45 pair 1 configuration. This capacitive arrangement is required, i.e., the innermost contacts from differential signal pair sets in a capacitive relationship, to reduce the complex mode of coupling to one. The complex reactance modes Xc are 114Xc--→116Xc and 118Xc--→120Xc for one half of the differential signal and the other half of the differential signal complex reactance modes Xc are 113Xc--→115Xc and 122Xc--→124Xc. All Quad (4) Xc sections are in separated zones, thus reducing the stray EMI between sections, which provides a more effective and balanced attack to reduce unwanted coupled signal noises.

The innermost contacts could also be contacts 20 and 26 with their respective pads being differential signal pair 3 of an EIA 568-B.2 RJ45 pin configuration. This configuration would aid in improving the impedance for differential signal pair 3, whose contacts are normally split, thereby reducing line capacitive reactance balance. Balance is re-inserted based on capacitance of the differential signal pair being the inner most combination. The contact arrangement could also be achieved with contacts 20, 24 with pads 113, 115 being the forward-most pad set, and the contacts 22, 26 with pads 114, 116. This arrangement of quad Xc accomplishes the same benefit, but provides another option for mechanical assembly.

Figure 5:
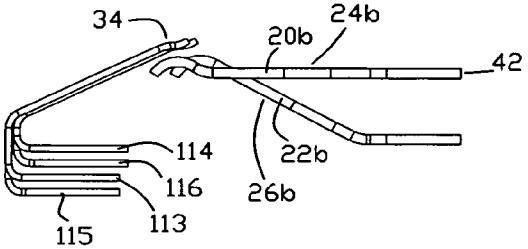
FIGS. 5-7 are side plan views of exemplary lead frames and associated capacitive structures according to a first embodiment of the present disclosure.
Figure 6:
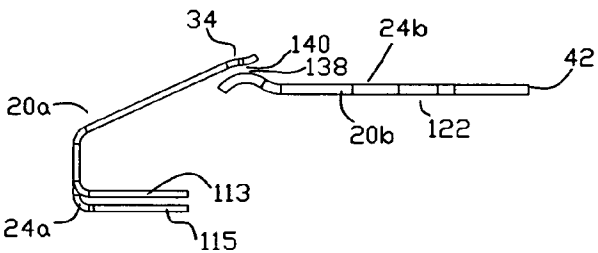
Figure 7:
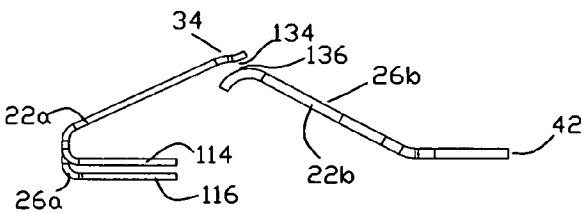

As illustrated in FIGS. 5, 6 and 7, inclusion of the various direction-altering segments in front end portions and rear end portions of lead frames 20, 22, 24, 26 can result in a placement or orientation of pins 42 which does not necessarily reflect the relative placement/orientation of lead frames 20, 22, 24, 26 at the opposite end thereof. Of note, the side views of FIGS. 5-7 illustrates the electrical "open" state of each of the center most lead frames 20, 22, 24 26. However, when mated with a FCC RJ45 plug at location 34, the front end portions of lead frames 20, 22, 24, 26 are forced/deflected in a downward direction toward the underlying rear end portion thereof. Such downward deflection brings the front end portion of each of the central bi-sectional lead frames, i.e., lead frames 20, 22, 24, 26, into electrical contact with the rear end portions thereof.

Both the front end portions and rear end portions of the bi-sectional lead frames are elongated beams that are supported in a cantilever fashion by the insert housing member. As a result, the forces exerted by the front and rear end portions of the two lead frames in the contact region constitute opposed forces, i.e., oppositely directed forces. The combined downward force of the front end portion and the upward force of the rear end portion of each bi-sectional lead frame is sufficient to provide reliable and stable contact resistance for signal transfer therebetween.

With further reference to FIG. 6, the capacitive interaction between pads/plates 113, 115 is further illustrated. As noted previously, capacitive pad 113 is in electrical contact with the front end portion 20*a* of lead frame 20, whereas capacitive pad 115 is in electrical communication with the front end portion 24*a* of lead frame 24. In the "open" state of FIG. 6, the rear end portions 20*b*, 24*b* are electrically isolated from such capacitive arrangement. Generally, the capacitive pad/plate 113 is integrally formed with the front end portion 20*a* of lead frame 20. Even if not integrally formed, capacitive pad/plate 113 and lead frame 20 are typically fabricated from the same material. Similarly, the capacitive pad/plate 115 and the front end portion 24*a* of lead frame 24 may be integrally formed and are typically fabricated from the same material.

A dielectric material (not pictured) may be introduced between capacitive pads/plates 113, 115 to provide insulation from potential electrical short and/or control of capacitive reactance therebetween. The dielectric material may be configured and dimensioned to support the capacitive pads/plated 113, 115 in whole or in part. For example, a greater presence of dielectric material generally reduces capacitive coupling between capacitive pads/plates 113, 115.

With further reference to FIG. 6, by bringing an appropriate plug, e.g., a FCC RJ plug, into electrical communication with lead frames 20, 24 and downward deflection of the front end portions occurs in region 34, electrical continuity extends/continues from the plug to the location/region of electrical contact 140 between the front and rear end portions of lead frames 20, 24. From such point of electrical contact 140, electrical continuity extends both (i) along front end portions 20*a*, 24*a* to respective capacitive pads/plates 113, 115, respectively, and (ii) along rear end portions 20*b*, 24*b* to terminals 42. In exemplary embodiments of the present disclosure, front and rear end portions 24*a*, 24*b* of lead frame 24 are substantially parallel to front and rear end portions 20*a*, 20*b* of lead frame 20.

FIG. 7 provides a similar view of the interplay between lead frames 22, 26 as is provided in FIG. 6 for purposes of lead frames 20, 24. Thus, capacitive pads/plates 114, 116 are in electrical communication with the front end portions 22*a*, 26*a* of lead frames 22, 26, respectively. Fabrication of the lead frames 22, 26 and capacitive pads/plates 114, 116 is generally handled in the same way as described herein with reference to lead frames 20, 24. A dielectric material may be optionally interposed between capacitive pads/plates 114, 116 for the reasons described herein. Upon introduction of an appropriate plug, e.g., a FCC RJ Plug, the front end portions 22*a*, 26*a* are brought into electrical contact with the underlying rear end portions 22*b*, 26*b* of bi-sectional lead frames 22, 26. Electrical continuity then extends from the plug to the capacitive pads/plates 114, 116 and the terminals 42.

Figure 8:
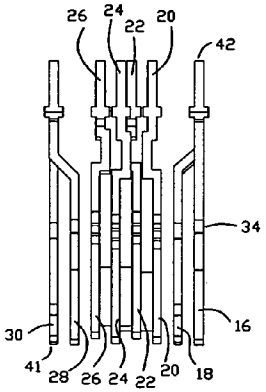
FIG. 8 is a top plan view of exemplary lead frames (separated from an underlying housing for ease of viewing) according to a first embodiment of the present disclosure.

FIG. 8 illustrates a top view of an exemplary lead frame arrangement according to the present disclosure. As shown therein, pairs of lead frames are arranged in an overlying (or substantially overlying) alignment for portions of such lead frame. Thus, lead frames 28, 30 are in an overlying/substantially overlying alignment for a prescribed distance, lead frames 22, 24 are in an overlying/substantially overlying alignment for a prescribed distance, and lead frames 16, 18 are in an overlying/substantially overlying alignment for a prescribed distance. Such overlying or substantially overlying alignment of lead frames is generally effective to impart capacitive coupling to the aligned lead frames, thereby functioning to further balance crosstalk noise introduced thereto in connection with plug/jack interaction.

Figure 10:
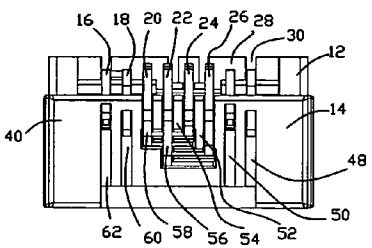
FIG. 10 is a front plan view of an exemplary embodiment of the present disclosure.

FIG. 9 provides a rear view of an exemplary insert according to the present disclosure. As depicted in FIG. 9, the exposed lead frame contacts may be advantageously aligned such that a first four (4) lead frames are substantially aligned in an upper plane, namely lead frames 16, 20, 24, 28, and a second four (4) lead frames are substantially aligned in a lower plane, namely lead frames 18, 22, 26, 30. The positioning and stabilization of the lead frames is effected through the design and interaction of upper portion 12 and lower portion 14 of insert housing member 11. Indeed, in exemplary embodiments of the present disclosure, channels are defined therewithin and/or therebetween to guide the lead frames to a desired location for alignment and access to terminals 42. At the opposite end, FIG. 10 provides a front view of an exemplary insert that illustrates, the relative positioning of lead frames 16 through 30.

Figure 11:
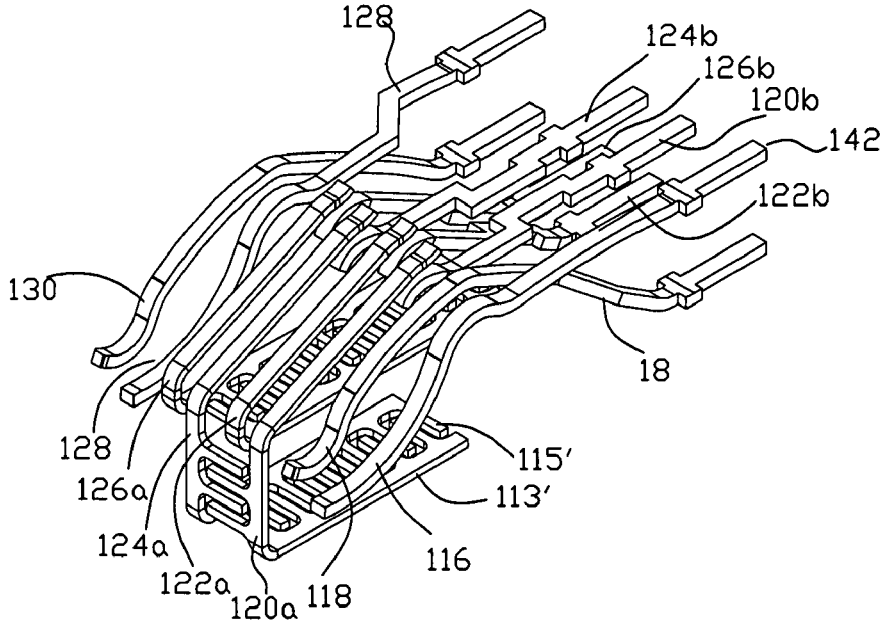
FIG. 11 is perspective view of alternative exemplary lead frames (separated from an underlying housing for ease of viewing) and associated capacitive structure according to a further embodiment of the present disclosure.
Figure 12:
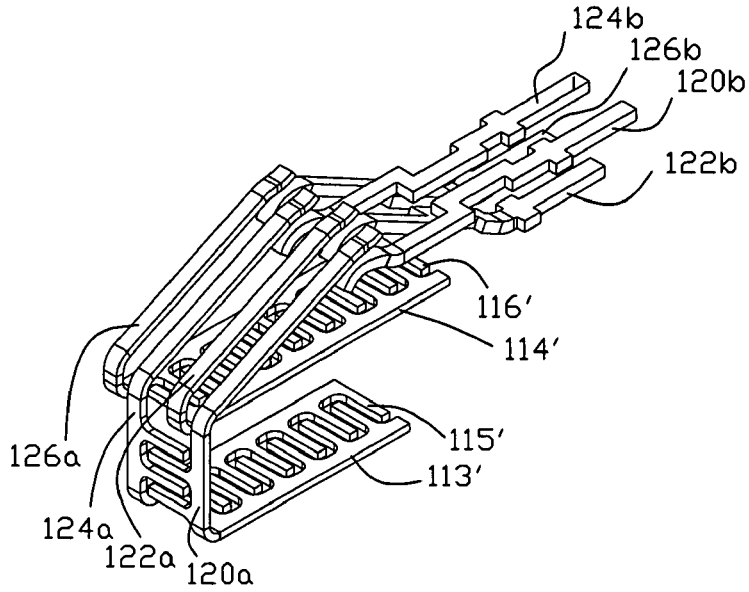
FIG. 12 is another perspective view of exemplary lead frames and associated capacitive structure according to an exemplary embodiment of the present disclosure.

Turning to FIGS. 11 and 12, an alternative bi-sectional lead frame design is illustrated according to a further exemplary embodiment of the present disclosure. The central four (4) lead frames are bi-sectional in design. Thus, front end portions 120*a*, 122*a*, 124*a*, 126*a* and rear end portions 120*b*, 122*b*, 124*b*, 126*b* define the four centrally positioned lead frames. Unlike the previously described exemplary embodiment, however, capacitive functionality is supplied by interdigitated stubs/fingers associated with capacitive members. Thus, as shown in FIGS. 11 and 12, capacitive members 113', 115' include interdigitated stubs/fingers that effect capacitive coupling therebetween, and capacitive members 114', 116' also include interdigitated stubs/fingers that effect capacitive coupling therebetween. Beyond the alternative capacitive design of FIGS. 11 and 12, the lead frame assembly depicted therein functions in like manner to that described with reference to FIGS. 1-10.

Figure 13:
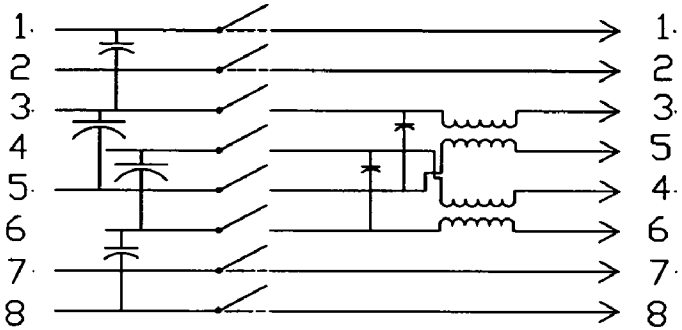
FIG. 13 is an electrical schematic of the reactance and switch potential normally open states of an exemplary embodiment of the present disclosure.
Figure 14:
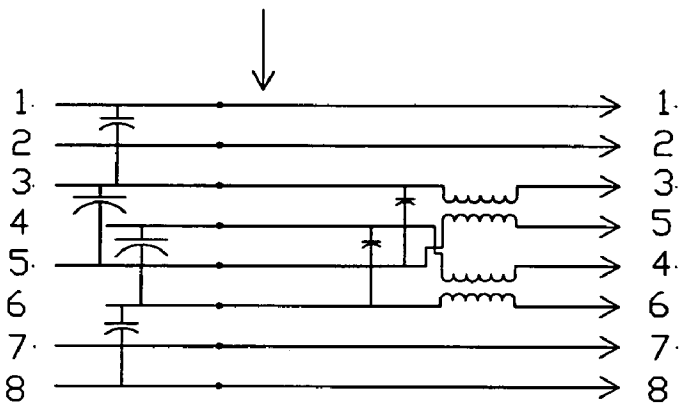
FIG. 14 is an electrical schematic of the reactance and switch potential mated/closed states of an exemplary embodiment of the present disclosure.

FIGS. 13 and 14 illustrate electrical schematic diagrams of the difference and isolated Xc sections of exemplary bi-sectional lead frame designs of the present disclosure. Input plug mating sections 1, 2, 3, 4, 5, 6, 7, 8 correspond to the front end portions of lead frames 16, 18, 20, 22, 24, 26, 28, 30, respectively. Output terminal mating sections 3, 4, 5, 6 correspond to the rear end portions 20*b*, 22*b*, 24*b*, 26*b* of lead frames 20, 22, 24, 26, respectively. In FIG. 13, lead frames 16 through 30 are schematically depicted in their normally "open" state, i.e., before plug mating. The dashed lines associated with mating sections 1, 2, 7, 8 reflect lead frames that can be designed in a conventional, non-interrupted manner, as shown in the exemplary embodiments of FIGS. 1-12, or in a bi-sectional manner, i.e., as disclosed for purposes of lead frames 20, 22, 24, 26.

Also schematically illustrated are potential locations for capacitive interaction between respective lead frames, including the capacitive pads/plates and/or interdigitated members disclosed herein. Of note, when an insert/jack that includes bi-sectional lead frames of the present disclosure is engaged with a conventional RJ-45 plug, all eight (8) contacts would assume the "closed" state that is schematically depicted in FIG. 14. However, to the extent a plug is brought into engagement with such insert/jack that features an alternative contact layout, e.g., a plug fabricated in compliance with the IEC 60603-7-7 standard, some or all of the contacts will remain in the "open" state depicted in FIG. 13. Thus, for example, the central four (4) mating sections 3, 4, 5, 6 may remain in the "open" state because an IEC 60603-7-7 compliant plug does not include contacts that would align therewith. In an IEC 60603-7-7 compliant design, the center-most contacts are repositioned to opposed corners of the jack, thereby reducing potential noise generation through interaction therebetween in the mating region. By maintaining mating sections 3, 4, 5, 6 in the "open" state for such central lead frames, the introduction of capacitive compensation based on capacitive coupling associated with the front end portions is prevented.

FIG. 14 thus illustrates exemplary noise reduction functionalities associated with exemplary embodiments of the present disclosure. In particular, front-end and rear-end capacitive effects may be combined to offset and/or compensate for noise generated through plug/jack interaction.

Figure 15:
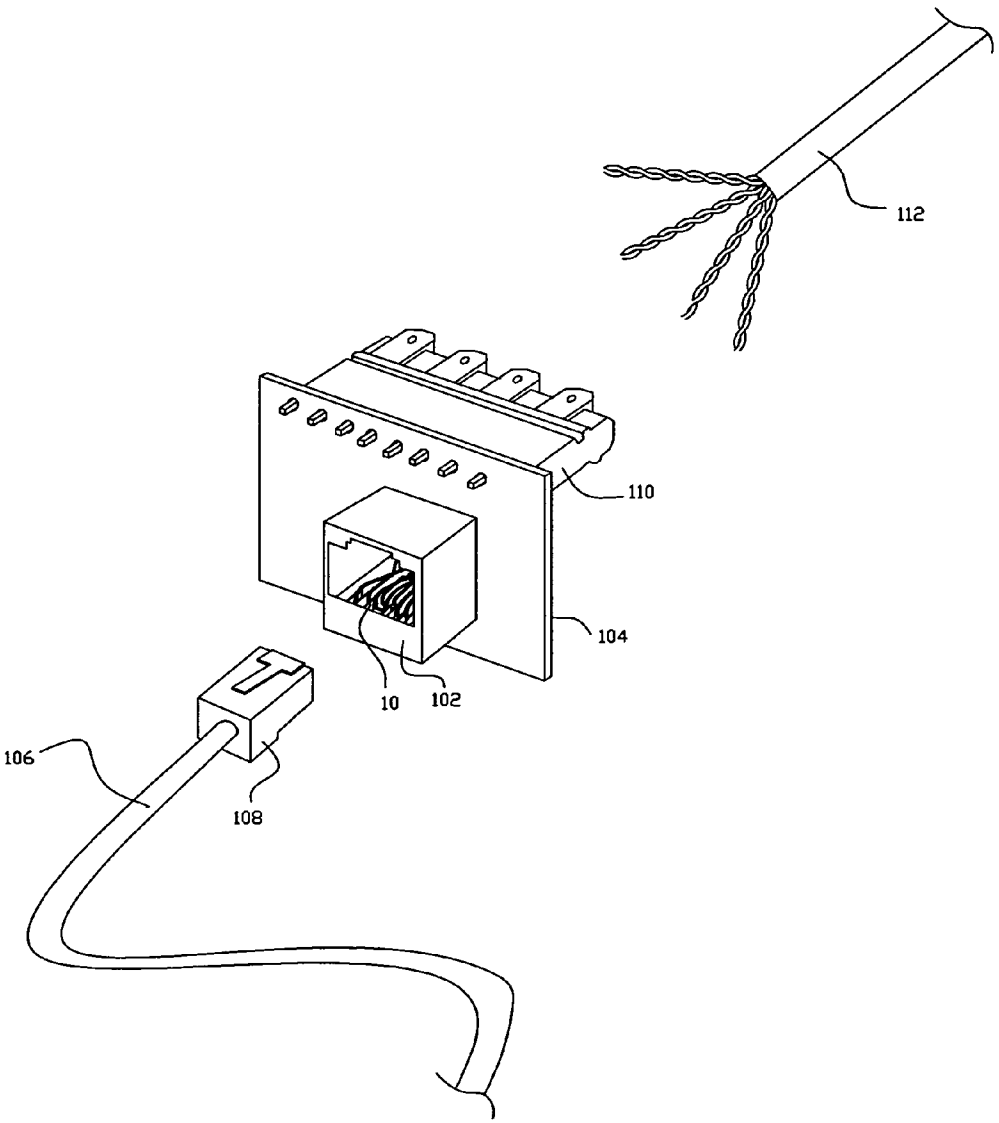
FIG. 15 is perspective view of an exemplary arrangement of components for use with exemplary inserts in accordance with the present disclosure.

FIG. 15 illustrates use of exemplary inserts and jacks of the present disclosure. Insert 10 is secured in modular housing 102 of a standard jack assembly for use in various applications, e.g., connection with a network wall outlet, computer or other data transfer device. Modular housing 102 with insert 10 is electrically connected to a printed circuit board ("PCB") 104 which may also contain signal transmission traces and/or extra coupling circuitry for re-balancing signals. Signals transfer from UTP cable 106 and into insert 10 through RJ45 type plug 108. The signal from cable 106 is transmitted via plug contacts 114 in plug 108, which make electrical contact substantially at contact portions 34 on front-end portions of lead frames 16, 18, 20, 22, 24, 26, 28, 30. The signal transfers from insert 10 via pins 42 into PCB 104. The signal is transferred from PCB 104 to insulation displacement contacts (IDC's) 110 which are connected to a second UTP cable 112, thus completing the data interface and transfer through insert 10.

The formation of lead frames 16 through 30 results in optionally splitting the signal which reduces crosstalk noises, among other things, by causing separate and quad reactance; that is, one being the rear-end dual inductive/capacitive reactance section combination and the other being the dual static mode capacitive reactance at the free-end of the elongated contacts central pairs. The lead frames may be arranged and/or bent in different formats. One format aligns all contacts in order, which increases the parallelism of the wire pairs. Another exemplary format, in accordance with the present disclosure, aligns all contacts in two distinct bends with the lead frames associated with upper portion 12 in parallel to each other and the lead frames associated with the lower portion 14 in parallel to each other, but not parallel with regard to lead frames of differing associations, which reduces NEXT more effectively.

By enhancing and reducing the parallelism of the lead frames at opposing end portions to address known coupling problems inherent in the RJ45 plug system, lower capacitive and inductive coupling will occur as the frequency increases up to 500 MHz. The end result is an insert device that has lower NEXT, FEXT and impedance in certain wire pairs. The reduction of a majority of crosstalk noise occurs by combining indirect and direct signal coupling in the lead frames associated with central pairs 1 and 3, as well as the other pairs 2 and 4 in the RJ45 plug.

Negative noise that was introduced is optionally counter coupled with a balance quad (4-section) positive noise, therefore reducing the total noise effects and re-balancing the wire pairs output. Each balance coupling section is located in separated isolated zones. By placement of such sections in isolated zones, the interaction of electro magnetic interference (EMI) between sections is greatly reduced. Such functionality may also be effective to reduce coupling variations.

The lead frames are generally electrically short, approximately less than 0.27 inches in length, which reduces the negative noise coupling by reducing the parallelism of the adjacent victim wire and reducing the signal delay to a PCB that could contain further coupling circuitry. The additive positive noise and reduction of the unwanted negative noise coupling of the lead frames works at substantially the same moment in time, which allows optimal reduction for lower capacitive and inductive coupling. The combination of the split signals provides, inter alia, an enhanced low noise dielectric modular housing for high speed telecommunication connecting hardware systems. The end result is a modular insert device that has lower NEXT, FEXT and impedance within its wire pairs.

Figure 16:
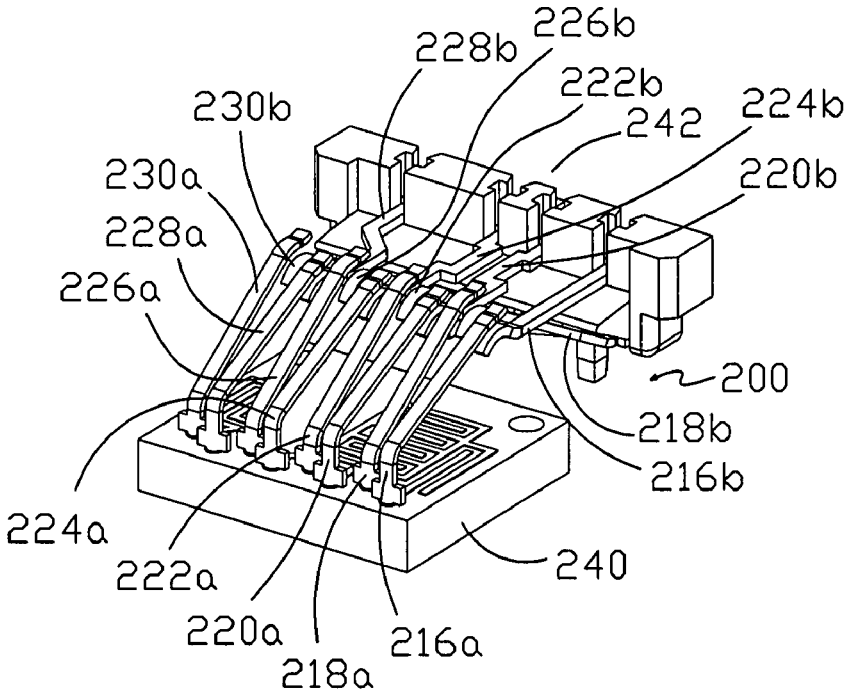
FIG. 16 is a perspective view of exemplary lead frames and associated capacitive structure according to a further exemplary embodiment of the present disclosure.
Figure 17:
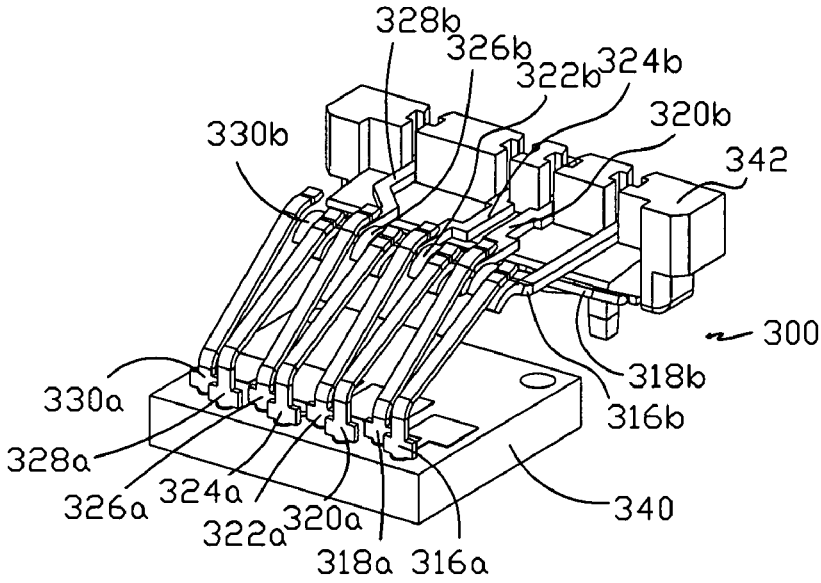
FIG. 17 is a perspective view of the exemplary lead frames of FIG. 16 associated with alternative capacitive structure according to a further exemplary embodiment of the present disclosure.

With reference to FIGS. 16-17, further exemplary embodiments of the present disclosure are schematically depicted. In particular, FIGS. 16 and 17 schematically depict bi-sectional lead frames in combination with a portion of an associated insert housing, and alternative PCB-based capacitive elements in electrical communication therewith. The disclosed inserts/lead frames are adapted to be combined with a plug assembly and utilized in data communication systems.

With initial reference to FIG. 16, subassembly 200 includes eight (8) bi-sectional lead frames that are defined by front end portions 216*a*, 218*a*, 220*a*, 222*a*, 224*a*, 226*a*, 228*a*, 230*a* and rear end portions 216*b*, 218*b*, 220*b*, 222*b*, 224*b*, 226*b*, 228*b*, 230*b*. Each of the lead frames is supported in a cantilevered fashion. Thus, the front end portions 216*a*, 218*a*, 220*a*, 222*a*, 224*a*, 226*a*, 228*a*, 230*a* are supported by PCB 240, whereas the rear end portions 216*b*, 218*b*, 220*b*, 222*b*, 224*b*, 226*b*, 228*b*, 230*b* are supported by insert housing 242. In an initial position, as depicted in FIG. 16, the front end portions and rear end portions are spaced from each other, i.e., in an "open" state. Such spacing is maintained based on the geometry of each of the front end portions/rear end portions, the cantilevered mounting of each such front end portion/rear end portion, and the strength/rigidity of each such component.

PCB 240 includes capacitive traces that function to introduce compensation to the lead frames when combined with a plug (not pictured). PCB 240 includes interdigitated capacitive traces that function to generate compensation for re-balancing the signals carried by the disclosed bi-sectional lead frames. To the extent a conventional RJ-45 plug is combined with subassembly 200, e.g., by connection to a jack containing subassembly 200, each of the bi-sectional lead frames deflects into a "closed" state. In other words, the front end portions 216*a*, 218*a*, 220*a*, 222*a*, 224*a*, 226*a*, 228*a*, 230*a* deflect into electrical contact with the rear end portions 216*b*, 218*b*, 220*b*, 222*b*, 224*b*, 226*b*, 228*b*, 230*b*. In the "closed" state, the capacitive functionality associated with PCB 240 generates compensation for purposes of offsetting noise generated in connection with the plug/jack assemblage.

In instances where a plug is introduced having an alternative contact layout, e.g., a plug that is compliant with the IEC 60603-7-7 standard, not all lead frames will be deflected to a "closed" state. Rather, certain lead frames may remain in the "open" state, thereby isolating the capacitive functionality associated with PCB 240 from generating compensation with respect to such lead frames. A completed circuit with respect to such wire pairs is generally achieved through alternately located contacts within the jack and associated plug. Of note, the bi-sectional design of the lead frames prevents the potential for energizing PCB 240 with respect to the "open" state lead frames from the downstream circuitry that is communication with the applicable rear end portions, e.g., rear end portions 220*b*, 222*b*, 224*b*, 226*b*.

Turning to FIG. 17, subassembly 300 is identical to subassembly 200 in all respects, with the exception of PCB 340 features a different capacitive design/functionality. More particularly, subassembly 300 includes eight (8) bi-sectional lead frames that are defined by front end portions 316*a*, 318*a*, 320*a*, 322*a*, 324*a*, 326*a*, 328*a*, 330*a* and rear end portions 316*b*, 318*b*, 320*b*, 322*b*, 324*b*, 326*b*, 328*b*, 330*b*. Each of the lead frames is supported in a cantilevered fashion, i.e., front end portions 316*a*, 318*a*, 320*a*, 322*a*, 324*a*, 326*a*, 328*a*, 330*a* are supported by PCB 340, and rear end portions 316*b*, 318*b*, 320*b*, 322*b*, 324*b*, 326*b*, 328*b*, 330*b* are supported by insert housing 342. The front end portions and rear end portions are initially in an "open" state, as described herein. Such spacing is maintained based on the geometry of each of the front end portions/rear end portions, the cantilevered mounting of each such front end portion/rear end portion, and the strength/rigidity of each such component.

PCB 340 includes capacitive traces that function to introduce compensation to the lead frames when combined with a plug (not pictured). PCB 340 includes capacitive pad-like or plate-like traces that function to generate compensation for re-balancing the signals carried by the disclosed bi-sectional lead frames. Thus, when a conventional RJ-45 plug is combined with subassembly 300, each of the bi-sectional lead frames deflects into a "closed" state, i.e., the front end portions 316*a*, 318*a*, 320*a*, 322*a*, 324*a*, 326*a*, 328*a*, 330*a* deflect into electrical contact with the rear end portions 316*b*, 318*b*, 320*b*, 322*b*, 324*b*, 326*b*, 328*b*, 330*b*. In the "closed" state, the capacitive functionality associated with PCB 340 generates compensation for purposes of offsetting noise generated in connection with the plug/jack assemblage.

As with the embodiment of FIG. 17 described above, in instances where a plug is introduced having an alternative contact layout, e.g., a plug that is compliant with the IEC 60603-7-7 standard, not all lead frames will be deflected to a "closed" state. Rather, certain lead frames may remain in the "open" state, thereby isolating the capacitive functionality associated with PCB 340 from generating compensation with respect to such lead frames. A completed circuit with respect to such wire pairs is generally achieved through alternately located contacts within the jack and associated plug. As noted with reference to the embodiment of FIG. 17, the bi-sectional design of the lead frames prevents the potential for energizing PCB 340 with respect to the "open" state lead frames from the downstream circuitry that is communication with the applicable rear end portions, e.g., rear end portions 320*b*, 322*b*, 324*b*, 326*b*.

Figure 18:
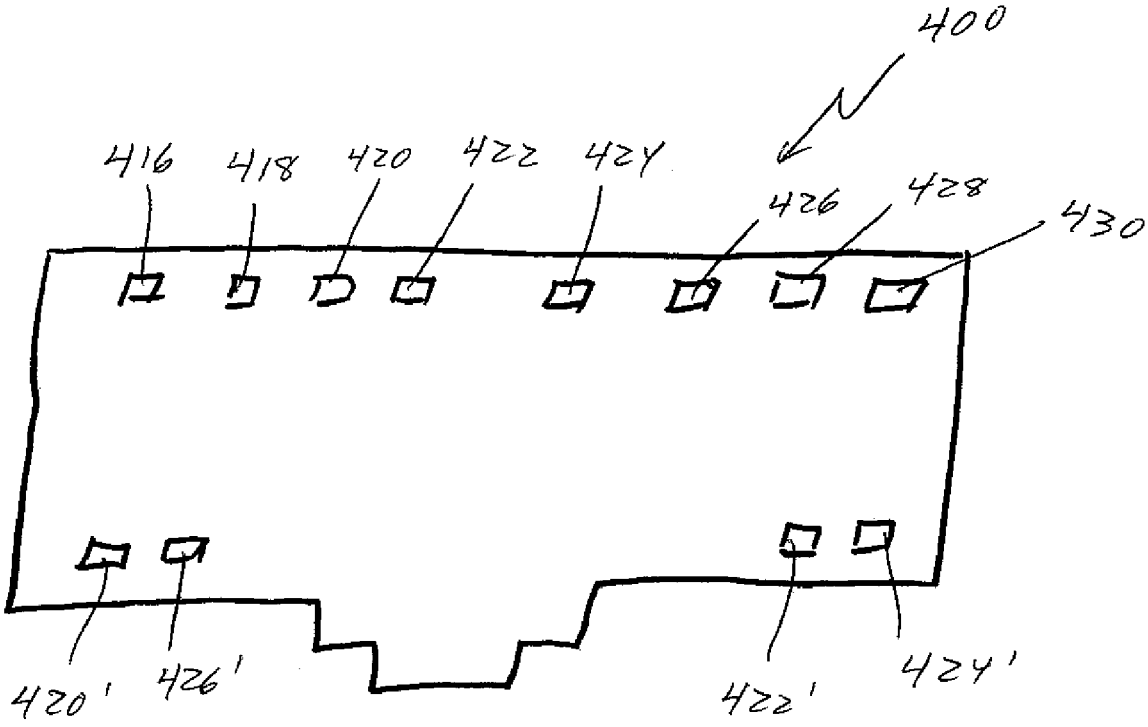
FIG. 18 is a front view of exemplary contact locations according to an exemplary jack housing of the present disclosure.

With reference to FIG. 18, a front view of an exemplary jack assembly 400 is provided, such jack assembly 400 accommodating plugs having differing contact layouts. Thus, jack assembly 400 includes eight contacts 416, 418, 420, 422, 424, 426, 428, 430 in a side-by-side orientation. Such contacts are positioned for cooperation with a conventional RJ-45 plug. Jack assembly 400 also includes ancillary contact pairs 420', 426' and 422', 424' in opposed corners of jack assembly 400. Such ancillary contact pairs are adapted, for example, to cooperate with a plug fabricated in accordance with the IEC 60603-7-7 standard. Thus, for an IEC 60603-7-7 plug, electrical communications through jack 400 would be achieved by way of contacts 416, 418, 420', 422', 424', 426', 428, 430. Contacts 420, 422, 424, 426 would not align with contacts in the IEC 60603-7-7 compliant plug, and the bi-sectional lead frames associated with such contact locations would remain in the "open" state, as described herein.

Thus, the systems, apparatus and methods of the present disclosure provide advantageous designs that automatically accommodate plugs having differing contact layouts, such advantageous designs supplying desired levels of compensation without requiring new equipment and/or expensive rewiring. Thus, in exemplary embodiments, the victim crosstalk noise is reduced/eliminated by the combination of appropriately-placed positive feedback signal reactance circuitry. This operation is accomplished by forming appropriate contacts within the dielectric insert for achieving requisite noise reduction for the contact geometry involved, thereby increasing the system's signal-to-noise ratio and reducing the system's bit error rate.

Signal noise is re-balanced by a requisite amount, based on the design/layout of the mating plug. For conventional RJ-45 contact layouts, front-end capacitive functionality is energized through deflection of the central bi-sectional lead frames, thereby transforming such lead frames from an "open" state to a "closed" state. Insert devices/jacks fabricated according to the present disclosure may be effective to reduce the differential noise input voltage ratio signal by at least fifty percent. This reduction and controlled Xc also aid in reducing the cabling Power Sum Alien Crosstalk (PSANEXT). By reducing the NEXT noise, the disclosed systems/methods also reduce the amount of coupling energy that has the potential to radiate upon an adjacent line. PSANEXT (as described in the EIA 568-B.2-10 document) is a new noise parameter that has a limited margin requirement for proper 10GBASE-T signal transmission over copper cabling.

Although the systems, apparatus and methods have been described with respect to exemplary embodiments herein, it is apparent that modifications, variations, changes and/or enhancements may be made thereto without departing from the spirit or scope of the invention as defined by the appended claims. Accordingly, the present disclosure expressly encompasses all such modifications, variations, changes and/or enhancements.

The invention claimed is:

1. An insert for use in a communication jack, comprising:

a. an insert housing member, b. a plurality of lead frames supported at least in part by said insert housing member, wherein at least one of said plurality of lead frames is a bi-sectional structure, said bi-sectional structure including a front end portion and a rear end portion; and c. a capacitive element in electrical communication with at least the front end portion of said bi-sectional structure.

2. The insert of claim 1, wherein insert member housing includes an upper portion and a lower portion that cooperate to capture and support the plurality of lead frames.

3. The insert of claim 1, wherein the plurality of lead frames includes eight (8) lead frames in a side-by-side orientation at least one end of the insert housing member.

4. The insert of claim 3, wherein the insert housing member is positioned in a jack housing, and wherein the jack housing further includes first and second contact pairs in opposed corners thereof.

5. The insert of claim 4, wherein the eight lead frames define two central pairs, and wherein the first and second contact pairs in the opposed corners of the jack housing correspond to said two central pairs.

6. The insert of claim 1, wherein the plurality of lead frames includes eight lead frames, and wherein each of the four central lead frames defines a bi-sectional structure.

7. The insert of claim 1, wherein the front end portion and the rear end portion are supported in a cantilevered manner.

8. The insert of claim 1, wherein the bi-sectional structure is adapted to move between a "closed" state wherein the capacitive element is in electrical communication and energized with a circuit associated with the bi-sectional structure, and an "open" state wherein the capacitive element is electrically isolated from the circuit.

9. The insert of claim 1, wherein the capacitive element is in communication with at least two of said plurality of lead frames.

10. The insert of claim 9, wherein the capacitive element includes a pair of spaced capacitive pads or plates.

11. The insert of claim 10, further comprising a dielectric positioned between said spaced capacitive pads or plates.

12. The insert of claim 9, wherein the capacitive element includes interdigitated elements or fingers.

13. The insert of claim 9, wherein the capacitive element includes capacitive traces on a printed circuit board.

14. The insert of claim 13, wherein the capacitive traces include at least one of capacitive pad traces, capacitive plate traces, and capacitive interdigitated traces.

15. The insert of claim 13, wherein the printed circuit board supports the front end portion of the bi-sectional structure in a cantilevered manner.

16. The insert of claim 1, wherein the capacitive element is effective to compensate for noise introduced to the lead frames through connection with a plug.

17. A jack assembly comprising:

a. a jack housing defining a plug-receiving space, and b. an insert assembly positioned within the jack assembly, the insert assembly including (i) an insert housing member, (ii) a plurality of lead frames supported by said insert housing member, wherein at least one of said plurality of lead frames is a bi-sectional structure, said bi-sectional structure including a front end portion and a rear end portion, and (iii) a capacitive element in electrical communication with at least the front end portion of said bi-sectional structure.

18. The jack assembly of claim 17, wherein the plurality of lead frames includes eight (8) lead frames in a side-by-side orientation exposed to the plug-receiving space.

19. The jack assembly according to claim 18, wherein the jack housing further includes first and second contact pairs in opposed corners thereof.

20. The jack assembly according to claim 19, wherein the eight lead frames define two central pairs, and wherein the first and second contact pairs in the opposed corners of the jack housing correspond to said two central pairs.

21. The jack assembly according to claim 17, wherein the plurality of lead frames includes eight lead frames, and wherein each of the four central lead frames defines a bi-sectional structure.

22. The jack assembly according to claim 17, wherein the front end portion and the rear end portion are supported in a cantilevered manner.

23. The jack assembly according to claim 17, wherein the bi-sectional structure is adapted to move between a "closed" state wherein the capacitive element is in electrical communication and energized with a circuit associated with the bi-sectional structure, and an "open" state wherein the capacitive element is electrically isolated from the circuit.

24. The jack assembly according to claim 17, wherein the capacitive element is in communication with at least two of said plurality of lead frames.

25. The jack assembly according to claim 24, wherein the capacitive element includes a pair of spaced capacitive pads or plates.

26. The jack assembly according to claim 25, further comprising a dielectric positioned between said spaced capacitive pads or plates.

27. The jack assembly according to claim 24, wherein the capacitive element includes interdigitated elements or fingers.

28. The jack assembly according to claim 24, wherein the capacitive element includes capacitive traces on a printed circuit board.

29. The jack assembly according to claim 28, wherein the capacitive traces include at least one of capacitive pad traces, capacitive plate traces, and capacitive interdigitated traces.

30. The jack assembly according to claim 28, wherein the printed circuit board supports the front end portion of the bi-sectional structure in a cantilevered manner.

31. The jack assembly according to claim 17, wherein the capacitive element is effective to compensate for noise introduced to the lead frames through connection with a plug.

* * * * *